US005904265A

United States Patent [19]

Zandbergen et al.

[11] Patent Number: 5,904,265

[45] Date of Patent: May 18, 1999

[54] TANK WITH AN INNER AND/OR OUTER DOUBLE-WALLED LINING

[75] Inventors: Jaap A. Zandbergen, Nuenen; Cornelius T.J.M. Swinkels, Helmond, both of Netherlands

[73] Assignee: Parabeam Industrie-En Handelsonderneming BV, Helmond, Netherlands

[21] Appl. No.: 08/887,454

[22] Filed: Jul. 2, 1997

[30] Foreign Application Priority Data

Jul. 2, 1996 [DE] Germany ..... 196 26 558

[51] Int. Cl.[6] ..... B65D 25/14

[52] U.S. Cl. ..... 220/62.19; 220/62.2; 220/62.11

[58] Field of Search ..... 220/62.19, 62.2, 220/62.15, 62.11

[56] References Cited

U.S. PATENT DOCUMENTS 5,269,436 12/1993 Bachmann .
5,534,318 7/1996 De La Porte et al. .

FOREIGN PATENT DOCUMENTS 0 470 321 A1 2/1992 European Pat. Off. .
0 504 708 A1 9/1992 European Pat. Off. .
0 602 471 A2 6/1994 European Pat. Off. .
0 436 210 A2 7/1994 European Pat. Off. .
3903216 A1 8/1990 German Dem. Rep. .

*Primary Examiner*—Joseph M. Moy
*Attorney, Agent, or Firm*—Cushman Darby & Cushman Intellectual Property Group of Pillsbury Madison & Sutro LLP

[57] ABSTRACT

The invention relates to a tank with an inner and/or outer cladding or lining, consisting of a tank wall and a double-walled cladding adhering to the latter and consisting of a double pile fabric which is reinforced by a curable impregnated resin and in which an upper and a lower fabric are connected so as to be spaced from one another by means of webs formed by pile threads, and with a closing-off laminate ply, the webs of the cladding forming, between the upper and the lower fabric, web walls extending linearly in one direction and consisting in each case of a multiplicity of pile threads arranged next to one another, and the web walls extending parallel to one another with small web heights of about 2.5 to 3.5 mm and with web wall spacings, greater than these of about 5 to 8 mm and, together with the upper and the lower fabric, delimiting individual cavity ducts.

12 Claims, 2 Drawing Sheets

TANK WITH AN INNER AND/OR OUTER DOUBLE-WALLED LINING

BACKGROUND OF THE INVENTION

The invention relates to a tank with an inner and/or outer double-walled lining.

Tank walls of this type with a lining have the advantage of improved corrosion resistance and make it possible to monitor leaks in the double-walled lining so that, in the event of a leak, harm to the environment is largely avoided.

So that, in the vent of a leak, the double-walled lining can withstand the pressure load which may possibly occur on the inside or outside of the tank wall, the latter must have sufficient compressive and shearing strength. On the other hand, the shearing strength of the lining should not be too high in order to avoid the lining adhering incompletely to the tank wall and/or coming loose from it.

SUMMARY OF THE INVENTION

An object of the invention is, therefore, to provide a tank with an inner and/or outer double-walled lining, the tank being more leak-resistant and, at the same time, being capable of being equipped with the lining simply and quickly.

Tank with an inner and/or outer lining, comprising a tank wall and a double-walled lining, adhering to the latter and comprising a double pile fabric which is reinforced by a curable impregnated resin and in which an upper and a lower fabric are connected so as to be spaced from one another by means of webs formed by pile threads, and with a sealing laminate ply, wherein the webs of the lining form, between the upper and the lower fabric, web walls extending linearly in one direction and consisting in each case of a multiplicity of pile threads arranged next to one another, and the web walls extend parallel to one another with small web heights of about 2.5 to about 3.5 mm and with web wall spacings, greater than these, of 5 to 8 mm and, together with the upper and the lower fabric, define individual cavity ducts.

These provide a tank with inner and/or outer double-walled lining, of which the lining, having a small wall thickness meets the requirements of an anti-leak lining. Thus, in comparison with known double-walled linings consisting of a double pile fabric, the pile density and web height are substantially lower, thus resulting in lower shearing strength. However, if the adjustment according to the invention is selected in conjunction with pile rows defining web walls extending linearly, an optimum lining for tank walls is obtained.

The double-pile fabric used is flat and can therefore be produced cost-effectively. Despite its flatness, the situation in which the cavity located between the upper and lower fabric and necessary for monitoring leaks fills up during impregnation with a curable resin is avoided. The resin to that extent embeds only the webs, so that largely closed web walls can be obtained along the linear arrangement of the pile threads which lie next to one another. These resinified web walls ensure that the flat double pile fabric has sufficient shearing strength, and even when these web walls are predominantly closed, there still remains sufficient permeability which is appropriate for the detection of leaks, particularly by means of compressed air.

The upper and lower fabrics are preferably a woven fabric, into which the pile threads are bound; in each case being looped around 5 to 7 weft threads. The spacings between the webs or web walls and consequently the width of the cavity ducts can thereby be adjusted according to the choice of thread thickness.

High-strength fibers, particularly glass fibers, are preferred as fiber material for the upper and lower fabric and for the pile threads.

The double pile fabric is adhesively bonded to the tank wall, preferably by means of a resin which may be reinforced with glass fibers and, as a laminate, can reinforce the double pile fabric on both sides.

Further embodiments of the invention can be taken from the following description and the subclaims.

The invention is explained in more detail below by means of the exemplary embodiments of the invention which is illustrated in the accompanying figures.

DETAILED DESCRIPTION OF THE INVENTION

Figure 1:
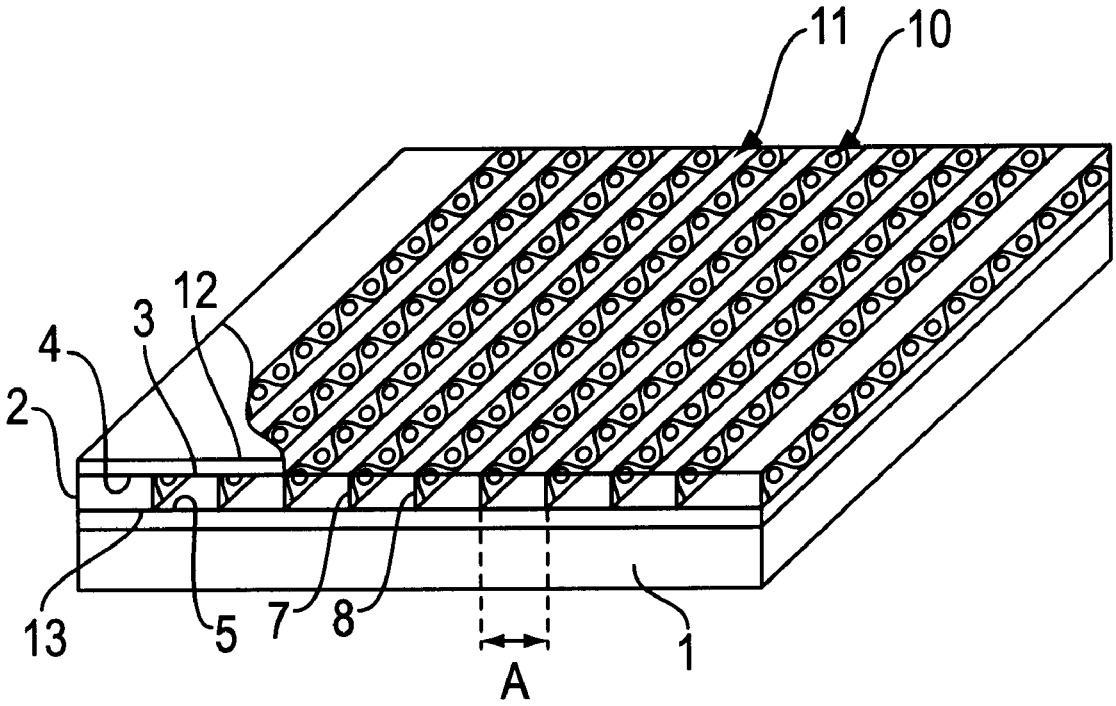
FIG. 1 shows diagrammatically a portion of a tank wall according to a first exemplary embodiment of the invention, an upper laminate ply and an upper fabric of a double pile fabric being partially omitted on the topside.

FIG. 1 shows a portion of a tank wall 1 of a generally cylindrical tank for receiving flowable or pourable goods, such as, in particular, chemicals and bulk petrochemical goods. A double-walled lining 2 is fastened to the outside and/or inside of the tank wall 1. Fastening is carried out preferably by adhesive bonding via a curable resin, in particular a duromeric reaction resin, such as, for example, polyester resin. A tank wall 1 consisting particularly of steel may be pretreated by being roughened, in particular by the use of sand-blasting method. A roughened tank wall 1 improves the adhesive bonding of the lining 2.

The double-walled lining 2 comprises a double pile fabric 3 which is reinforced by a curable resin and which lines the tank wall 1 in the radial or longitudinal direction in one or more sheets laid next to one another.

The double pile fabric 3 is an uncut multi-ply fabric with an upper fabric 4 and with a lower fabric 5 which are connected to one another and held spaced from one another by means of pile threads 6 (see FIG. 2) which alternate to and from between the upper fabric 4 and the lower fabric 5 and form webs 7, 8 there. The upper fabric 4, the lower fabric 5 and the webs 7, 8 are reinforced to form a structural part by being resinified with a curable resin.

Figure 2:
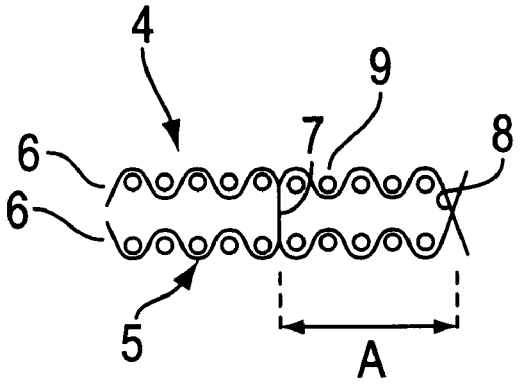
FIG. 2 partially shows diagrammatically a portion of a weave of a woven double pile fabric of the tank wall according to FIG. 1.

In this case, the pile threads 6 are bound into the upper fabric 4 and the lower fabric 5 in such a way that a length segment A of about 5 to about 8 mm lies in each case between two adjacent webs 7 and 8 formed by the pile threads 6 when they cross between the upper fabric 4 and lower fabric 5. If the double pile fabric is preferably a woven fabric with crossed weft threads 9 and warp threads (not shown in FIG. 2), this length segment A may be adjusted by binding the pile threads 6 in the upper fabric 4 and lower fabric 5, in each case looping round 5 to 7 weft threads 9. FIG. 2 illustrates a looping of five weft threads 9 in each case. Preferably, if the double pile fabric is a woven fabric, two warp systems of pile threads 6 are also provided and are bound alternately into the upper fabric 4 and lower fabric 5. The density of the non-resinified upper and lower fabrics 4, 5 may be adjusted via the number of warp threads and weft threads 9 per square centimeter. If loose upper and lower fabrics 4, 5 are required, so that leaks in the tank wall 1 can be indicated as quickly as possible, fewer weft threads as basting threads are distributed per square centimeter. For example, in the case of 10 basting threads per square centimeter, only 9 or 9.5 weft threads 9 are distributed.

The height of the webs 7, 8 is only about 2.5 to about 3.5 mm. Furthermore, the pile threads 6 are bound in next to one another in pile rows, in such a way that the webs 7, 8 produced form linear web walls 10 which extend parallel to one another and which, together with the upper fabric 4 and the lower fabric 5, define individual cavity ducts 11. The height of the webs 7, 8 and consequently of the web walls 10 is consequently smaller than the width of the web wall spacings. The web wall spaces may be more than twice as large as the height of the web walls 10. The webs 7, 8 along the web walls 10 are preferably embedded into the cured resin in such a way that the web walls 10 are predominantly closed. The upper fabric 4 and lower fabric 5 thus form two reinforced walls which are spaced from one another and the interposed volume of which is filled only partially by the likewise reinforced web walls 10 and is otherwise essentially empty.

High-strength fibers, such as, for example, glass fibers, carbon fibers and aramide fibers, serve as fiber material for the upper fabric 4, the lower fabric 5 and the pile threads 6, as well as their webs 7, 8. In this case, the fibers used may either be spun as staple fibers to form yarns or be designated as monofilaments or multifilaments.

Finally, the lining 2 may be reinforced and covered on one side or on both sides with a laminate ply 12, 13 consisting of preferably glass-fiber-reinforced plastic. The upper laminate ply 12 may be covered with a covering layer, thus resulting in a particularly smooth outer skin which, moreover, can ensure sealing. The lower laminate ply 13 may form an intermediate layer between the tank wall 1 and lining 2, the said intermediate layer bringing about an additional build-up of the tank wall and consequently increasing the life of a tank.

In order to attach the lining 2 to the tank wall 1, one or more sheets of the double pile fabric may be laid on in the radial direction of the tank, in such a way that a seam located on the topside of the tank is formed. Alternatively, the double pile fabric may be laid on in the longitudinal direction of the tank. In this case, the cavity ducts 11 may terminate in a seam region or connecting region and communicate with one another via this so that, even when the web walls 10 are largely closed, the various cavity ducts are connected to one another, with the result that the monitoring of leaks can extend over the entire cladding. If the web walls 10, in particular the spaces between the individual webs in a pile row, are not closed completely by the impregnated resin, the cavity ducts 11 can also communicate with one another via the web walls 10.

The resin used for impregnating the double pile fabric is a curing reaction resin, such as, for example, unsaturated polyester, epoxides, vinylester, phenols, polyurethane (PUR), silicones (SI), polyimides (PI) or polyamidimides (PAI). UV-curing resins are also suitable.

Monitoring of leaks is carried out in the classing 2 by means of known leak monitoring systems.

Figure 3:
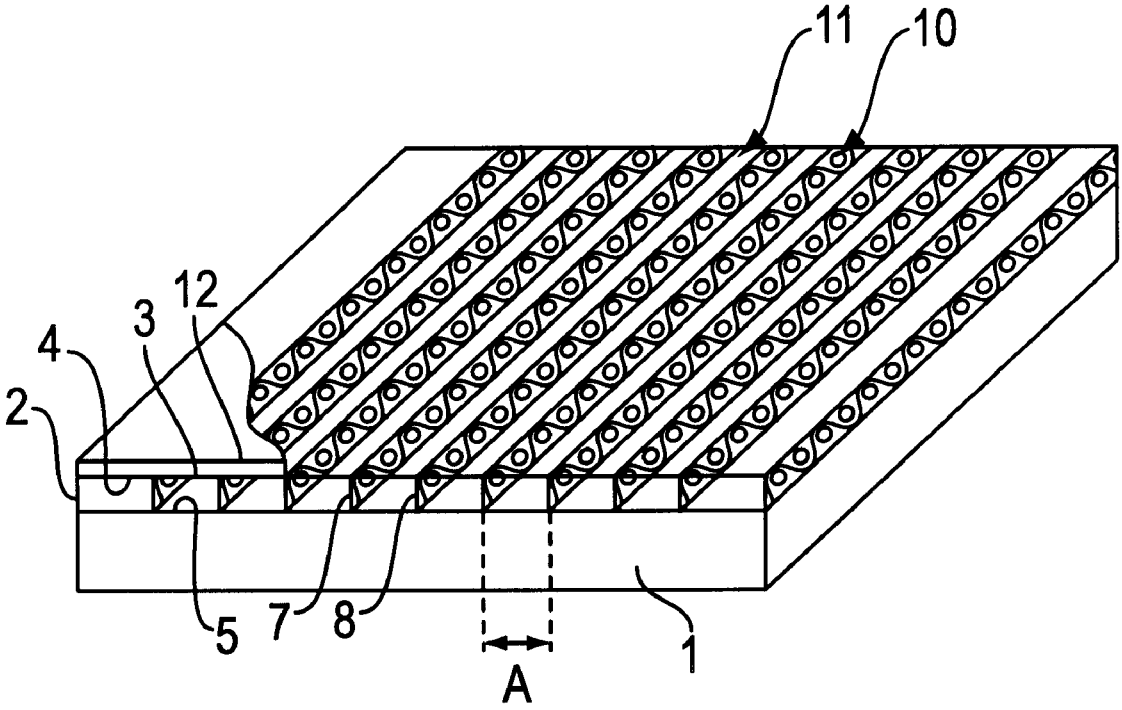
FIG. 3 shows diagrammatically a portion of a tank wall according to a second exemplary embodiment of the invention, an upper laminate ply and an upper fabric of a double pile fabric being partially omitted on the topside.

The further exemplary embodiment according to FIG. 3 differs from the described above only in that the lining 2 adheres directly to the tank wall 1. The intermediate layer 13 according to FIG. 1 is dispensed with. The foregoing embodiments otherwise apply accordingly.

Although the invention has been described in connection with what is presently considered to be the most practical and preferred embodiments, it is to be understood that the invention is not limited to the disclosed embodiments but rather is intended to cover various modifications and equivalent arrangements including within the spirit and scope of the appended claims.

What is claimed is:

1. Tank with a lining, comprising a tank wall and a double-walled lining adhering to the latter and comprising a double pile fabric which is reinforced by a curable impregnated resin and in which an upper and a lower fabric are connected so as to be spaced from one another by means of webs formed by pile threads, and with a sealing laminate ply, wherein the webs of the lining form, between the upper and the lower fabric, web walls extending linearly in one direction and consisting in each case of a multiplicity of pile threads arranged next to one another, and the web walls extend parallel to one another with small web heights of about 2.5 to about 3.5 mm and with web wall spacings, greater than these, of about 5 to about 8 mm, said curable impregnated resin embedding the webs to obtain substantially closed web walls along the linear arrangement of the pile threads which lie next to one another and, together with the upper and the lower fabric define individual cavity ducts.

2. Tank according to claim 1 wherein the web walls are predominantly closed by webs embedded into cured resin.

3. Tank according to claim 1 wherein the individual cavity ducts communicate with one another via the web walls.

4. Tank according to claim 1 wherein the upper and the lower fabric are a woven fabric with crossed warp and weft threads and the pile threads are bound into the upper and lower fabric in each case looping around about 5 to about 7 weft threads.

5. Tank according to claim 1 wherein the upper and lower fabric and the pile threads consist of high-strength fibers, particularly glass fibers.

6. Tank according to claim 1 wherein the lining consisting of individual sheets placed against one another along a seam located on the topside of the tank adheres to the tank wall by means of a shrink-on resin.

7. Tank according to claim 1 wherein the laminate ply is a glass-fiber reinforced resin laminate.

8. Tank according to claim 1 wherein the lining adheres to a tank wall roughened by pretreatment.

9. Tank according to claim 1 wherein an intermediate layer is arranged between the tank wall and the lining.

10. Tank according to claim 9 wherein the intermediate layer comprises a cured glass-fiber-reinforced resin laminate.

11. Tank according to claim 1 wherein the upper and lower fabrics each consist of a woven fabric, the density of which is adjusted in such a way that fewer weft threads than warp threads are distributed per square centimeter.

12. Tank according to claim 1 wherein the laminate ply is covered with a covering layer.

* * * * *